US006089041A

United States Patent [19]

Higginbotham

[11] Patent Number: 6,089,041

[45] Date of Patent: Jul. 18, 2000

[54] AIR SEPARATION

[75] Inventor: Paul Higginbotham, Guildford, United Kingdom

[73] Assignee: The BOC Group plc, Windlesham, United Kingdom

[21] Appl. No.: 09/276,373

[22] Filed: Mar. 25, 1999

Related U.S. Application Data

[62] Division of application No. 08/828,905, Apr. 2, 1997.

[30] Foreign Application Priority Data

Apr. 4, 1996 [GB] United Kingdom ..... 96072004

[51] Int. Cl.[7] ..... F25J 3/04

[52] U.S. Cl. ..... 62/648; 62/643

[58] Field of Search ..... 62/640, 646, 647, 62/652, 648, 643

[56] References Cited

U.S. PATENT DOCUMENTS 4,560,397 12/1985 Cheung ..... 62/640
4,822,395 4/1989 Cheung ..... 62/647
4,838,913 6/1989 Victor et al. ..... 62/646
5,049,173 9/1991 Cormier et al. ..... 62/646
5,209,070 5/1993 Darredeau ..... 62/646
5,469,710 11/1995 Howard et al. ..... 62/646
5,582,033 12/1996 Bonaquist et al. ..... 62/643
5,743,112 4/1998 Yamamoto et al. ..... 62/673

*Primary Examiner*—William Doerrler
*Attorney, Agent, or Firm*—David M. Rosenblum; Salvatore P. Pace

[57] ABSTRACT

Air is separated in a double rectification column including a lower pressure rectification column. A first oxygen product containing less than 3.5% by volume of argon impurity is withdrawn through an outlet of the column which has a packed section below the level of the outlet. The argon impurity is striped from liquid descending through the packed section and a second relatively pure oxygen product containing less than 100 volumes per million is withdrawn from below the section through an outlet thereof. Impurities less volatile than oxygen are preferably separated from the second oxygen product in a side rectification column.

6 Claims, 1 Drawing Sheet

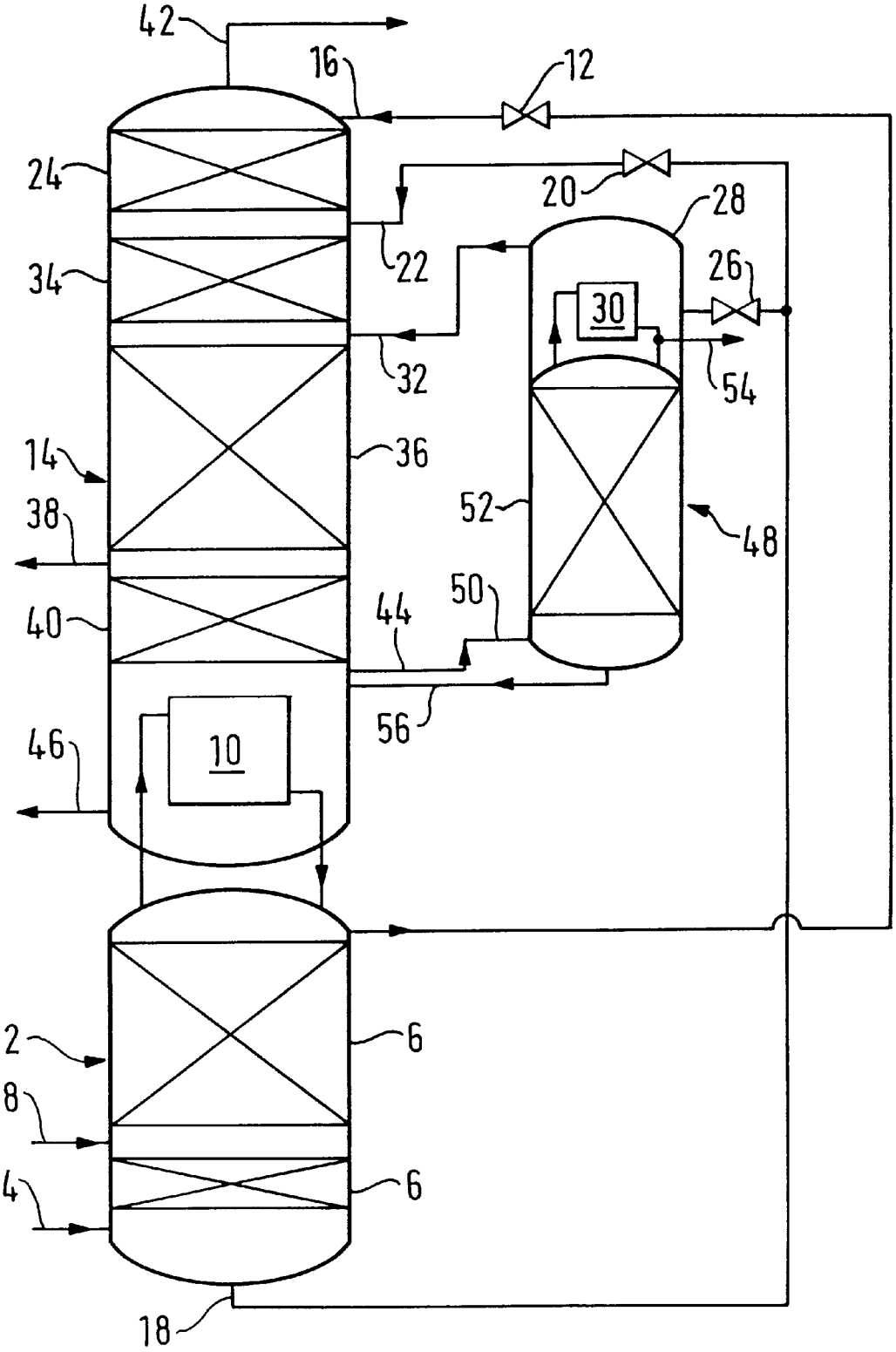
42
16
12
24
20
28
22
34
26
30
32
54
14
36
52
48
38
50
44
40
56
46
10
2
6
8
4
6
18

AIR SEPARATION

RELATED APPLICATIONS

This is a division of application Ser. No. 08/828,905 filed Apr. 2, 1997.

BACKGROUND OF THE INVENTION

This invention relates to a method and apparatus for separating air. In particular, it relates to production of both a first oxygen product typically of normal purity and a second particularly pure oxygen product containing less than 100 volumes per million of argon impurity, and preferably less than 1 volume per million of all impurities.

One conventional method of separating oxygen from air comprises purifying the air by removal of water vapour and carbon dioxide impurities, cooling the purified air to a temperature suitable for its separation by cryogenic rectification, and subjecting the cooled air to rectification in a double rectification column comprising a higher pressure rectification column and a lower pressure rectification column. Typically, the top of the higher pressure rectification column exchanges heat with the bottom of the lower pressure rectification column so as to condense nitrogen separated in the higher pressure rectification column and reboil liquid oxygen separated in the lower pressure column. The lower pressure column typically has a bottom section in which argon is separated from oxygen. It is therefore possible to produce an oxygen product containing less than 3% by volume of argon. Indeed, no difficulty presents itself in producing an oxygen product containing no more than 0.1% by volume of argon. If, however, an oxygen product of substantially higher purity is required, there is a need to use one or more additional rectification or fractionation columns in order to remove impurities from an oxygen-containing stream withdrawn from the lower pressure rectification column. No only may there be a need to remove impurities such as argon which are more volatile than oxygen, there may also be a need to remove impurities such as methane which are less volatile.

U.S. Pat. No. 5,049,173 discloses taking a feed stream from a region of the lower pressure column where the oxygen concentration is in the range of 1–35% by volume and stripping argon and other low volatility impurities from the stream in a side column. By taking the feed stream from a region of the lower pressure column where the oxygen concentration is in the range of 1 to 35% by volume, the concentration of impurities of relatively low volatility, for example, methane, in the feed stream is kept to a minimum. It is therefore possible to obtain a liquid oxygen product from the side column containing less than 1 volume per million of impurities in total. One disadvantage of this process is that a relatively large number of theoretical stages is required in the side column. In one example, approximately 64 stages are used. Another disadvantage is that the maximum production of high purity oxygen is in a typical example limited to 19% of the total oxygen production. A yet further disadvantage is that if the low pressure column is required to separate a stream of liquid air in addition to an at least partially vaporised fraction withdrawn from the bottom of the higher pressure rectification column, the feed to the side column contains less oxygen and therefore the total proportion of the oxygen products that can be produced at high purity is reduced.

U.S. Pat. No. 4,560,397 discloses a process in which the sole oxygen product is of high purity, containing, in one example, 10 ppm of argon, 1.3 ppm of krypton and 8 ppm of methane. A primary, higher pressure, rectification column and a secondary, lower pressure, rectification column are employed. An oxygen-enriched stream may be withdrawn from the primary column a few trays above the bottom tray so as to ensure that it contains a smaller concentration of impurities less volatile than oxygen than would be the case were it to be withdrawn from the bottom of the primary column. The oxygen-enriched stream is passed to the top of the secondary column which removes the argon impurity. A vaporous high purity oxygen stream is withdrawn from the secondary column at a point at least one theoretical tray above the bottom of this column The secondary column is provided with a reboiler which is heated by nitrogen separated in the primary column. The nitrogen is thus condensed and is returned to the primary column so as to provide reflux for this column. However, in order to provide adequate reflux for the primary column, it is necessary to provide an additional means for condensing the nitrogen. A second condenser is therefore provided. This secondary condenser is cooled by a stream of oxygen-enriched liquid withdrawn from the bottom of the primary column. The resulting oxygen-enriched vapour is warmed by indirect heat exchange with the incoming air, is expanded in a turbine to provide refrigeration for the process, and is then rewarmed to ambient temperature by indirect heat exchange with the incoming air. As a result, the maximum yield of high purity oxygen that can be obtained is considerably reduced since a considerable proportion of the incoming oxygen is effectively vented from the process in the stream which is rewarmed.

SUMMARY OF THE INVENTION

It is an aim of the present invention to provide a method and apparatus for separating from air a first oxygen product containing less than 3.5% by volume of argon impurity, and a second oxygen product containing less than 100 volume per million of argon impurity, which method and apparatus require no additional column to the higher pressure rectification column and the lower pressure rectification column in order to obtain the requisite low argon impurity level in the second oxygen product, but which, if desired, can use a further rectification column in order to produce a second oxygen product containing less than 1 volume per million in total of impurities.

According to the present invention there is provided a method of separating from air a first oxygen product containing less than 3.5% by volume of argon impurity and a second relatively pure oxygen product containing less than 100 volumes per million of argon impurity (and preferably less than 1 volume per million of argon impurity), comprising fractionating an air stream in a higher pressure rectification column so as to form a bottom liquid fraction enriched in oxygen and a top vaporous nitrogen fraction, introducing a stream of the bottom fraction into a lower pressure rectification column for separation therein, condensing a flow of the vaporous nitrogen fraction by indirect heat exchange with a liquid oxygen fraction separated in the lower pressure rectification column and thereby boiling at least a part of the liquid oxygen fraction and creating a vapour flow upwardly through the lower pressure rectification column, employing at least some of the so-formed condensate as reflux in the higher pressure rectification column, supplying a stream of liquid from the higher pressure fractionation column to the lower pressure rectification column as reflux, wherein the first oxygen product is withdrawn from an intermediate region of the lower pressure rectification column, there is a packed section of the lower pressure rectification column which receives liquid from said intermediate region, in which section argon impurity is stripped from the liquid so received, the second oxygen product is withdrawn from the bottom of the packed section, and all the cooling to form the condensate is provided by the liquid oxygen fraction.

The invention also provides apparatus for separating from air a first oxygen product containing less than 3.5% by volume of argon impurity and a second relatively pure oxygen product containing less than 100 volumes per million of argon impurity comprising a higher pressure rectification column for fractionating an air stream so as to form a top vaporous nitrogen fraction and a bottom liquid fraction enriched in oxygen, a lower pressure rectification column for separating a stream of the bottom fraction, a condenser-reboiler for condensing a flow of the vaporous nitrogen fraction by indirect heat exchange with a liquid oxygen fraction separated in the lower pressure rectification column, the condenser-reboiler being arranged so as, in use, to provide an upward flow of vapour through the lower pressure rectification column and to provide reflux for the higher pressure rectification column, an inlet to the higher pressure rectification column for a stream of reflux, said inlet communicating directly or indirectly with the lower pressure rectification column, a first outlet for the first oxygen product from an intermediate region of the lower pressure rectification column, a packed section in the lower pressure rectification column arranged to receive liquid from the said intermediate region, said packed section enabling argon impurity to be stripped from the descending liquid, a second outlet for the second oxygen product communicating with the bottom of the packed section, and the condenser-reboiler having its condensing passages communicating at their inlet end with a single source of heating fluid, said single source being a bottom region of the lower pressure rectification column.

If it is required to produce a second product having a reduced concentration of "heavy" impurities, and typically containing less than 100 volumes per million in total of impurities, preferably less than 1 volume per million in total, a stream of the second product is preferably passed into a side fractionation column and impurities, particularly methane, less volatile than oxygen are separated therefrom. The side column is preferably provided with a condenser. The condenser may be cooled by any convenient stream. For example, a stream of oxygen-enriched liquid from the bottom of the higher pressure fractionation column may be used for this purpose.

The second product stream may be withdrawn from the lower pressure rectification column in liquid or vapour state. If withdrawn in liquid state, the side column, if employed, is provided with a reboiler.

Preferably, a stream of liquid containing impurities less volatile than oxygen is vented from one or both of the lower pressure rectification column and the side column.

If desired, an argon product may be separated from the air in addition to the first and second oxygen products. For this purpose, a second side column may receive an argon-containing oxygen stream from the lower pressure rectification column and be arranged so as to separate an argon product therefrom.

The term "rectification column", as used herein, means a distillation or fractionation column, zone or zones, wherein liquid and vapour phases are countercurrently contacted to effect separation or purification of a fluid mixture, as for example, by contacting the vapour and liquid phases on packing elements or a series of vertically spaced trays or plates mounted within the column, zone or zones. A rectification column may comprise a plurality of zones in separate vessels so as to avoid having a single vessel of undue height. For example, it is known to use a height of packing amounting to 200 theoretical plates in an argon rectification column. If all this packing were housed in a single vessel, the vessel may typically have a height of over 50 metres. It is therefore obviously desirable to construct the argon rectification column in two separate vessels so as to avoid having to employ a single, exceptionally tall, vessel. The method and apparatus according to the present invention enable a second oxygen product typically containing no more than 100 parts by volume per thousand million of total impurities to be separated. If desired, the proportion of the oxygen product that may be taken in high purity form may be greater than in the method according to U.S. Pat. No. 5,049,173. Further, the method and apparatus according to the present invention are not as susceptible as the method and apparatus disclosed in U.S. Pat. No. 5,049,173 to loss of oxygen recovery with increasing oxygen production or with an increasing demand for liquid products. This is because the vapour/liquid load in the side column for a given incoming air flow is less in the method and apparatus according to the invention than it is in a method and apparatus disclosed in U.S. Pat. No. 5,049,173. Further advantages are that the vapour flow through the side rectification column is typically less than half that in the corresponding column of the method and apparatus according to U.S. Pat. No. 5,049,173, and the number of theoretical stages employed in this column is typically less than one third. The requirement for the packed argon stripping section does however add height to the lower pressure rectification column.

BRIEF DESCRIPTION OF THE DRAWING

The method and apparatus according to the present invention will now be described by way of example with reference to the accompanying drawing which is a schematic flow diagram of an arrangement of rectification columns forming part of an air separation plant.

The drawing is not to scale.

DETAILED DESCRIPTION

Referring to the drawing, a stream of pressurised, purified, vaporous air at approximately its saturation temperature is introduced into a higher pressure rectification column 2 through an inlet 4. The inlet 4 is located below the level of all trays or other liquid-vapour contact devices 6 within the column 2. The air stream is typically formed in a manner well known in the art, that is, it is compressed, the compressed stream is purified by adsorption of water vapour and carbon dioxide impurities therefrom, and the purified stream is cooled by indirect heat exchange with return streams from the arrangement of columns to be described below.

The higher pressure rectification column 2 has a second inlet 8 at a level at a higher elevation than some liquid-vapour contact devices 6 in the column 2 but below others. The liquid air stream is typically formed by liquefying a stream of purified air, typically taken from the same source as that from which the stream of air entering the column 2 through the inlet 4 is taken. The air may be liquefied in a manner well known in the art.

The air is separated in the higher pressure rectification column 2 into a nitrogen vapour fraction and an oxygen-enriched liquid air fraction. Typically, the pressure at the top of the higher pressure rectification column 2 is in the range of 4 to 6 bar.

Nitrogen vapour flows from the top of the higher pressure rectification column 2 into a condenser-reboiler 10 and is condensed therein. A part of the condensate is returned to the higher pressure rectification column 2 as reflux. Another part flows through a Joule-Thomson or throttling valve 12 and passes into a lower pressure rectification column 14 through an inlet 16 at a top region thereof. This way, liquid nitrogen reflux is provided for the lower pressure rectification column 14. A stream of oxygen-enriched liquid is withdrawn from the higher pressure rectification column 2 through an outlet 18. The flow of oxygen-enriched liquid air is divided. A part passes through a Joule-Thomson or throttling valve 20 and is introduced into the lower pressure rectification column 14 through an inlet 22 which is located at an upper level of the lower pressure rectification column 14. There is a section 24 of packing or other liquid-vapour contact devices extending from just above the level of the inlet 22 to near the top of the lower pressure rectification column 14. The other part of the flow of the oxygen-enriched liquid air flows through a Joule-Thomson or throttling valve 26 into a vessel 28 in which a further condenser-reboiler 30 is housed. The oxygen-enriched liquid air is typically totally boiled in the condenser-reboiler 30. The resulting vapour flows into the lower pressure rectification column 14 through an inlet 32 at a level below that of the inlet 22 there is an intermediate section 34 of packing or other liquid-vapour contact devices extending from a level just above that of the inlet 32 to a level just below that of the inlet 22.

There is a further intermediate section 36 of packing or other liquid-vapour contact devices in the lower pressure rectification column 14 extending from a level just below that of the inlet 32 to just above the level of an outlet 38 from the column 14 for a vaporous oxygen product typically containing 99.5%(?) by volume of oxygen. There is a bottom section 40 of packing in the lower pressure rectification column 14. The section 40 extends from a level just below that of the outlet 38 to a level a little above the top of the reboiler-condenser 10 (which is housed in the sump of the lower pressure rectification column 14).

There are three further outlets from the lower pressure rectification column 14. First there is an outlet 42 for nitrogen vapour at the top of the lower pressure rectification column 14. Second, there is an outlet 44 for reboiled liquid oxygen issuing from the condenser-reboiler 10. Third, there is an outlet 46 from the sump of the lower pressure rectification column 14 through which a purge stream may be discharged from the process.

The lower pressure rectification column 14 is typically operated at a pressure (at its top) in the range of 1 to 1.5 bar. The oxygen-enriched air introduced into the column 14 through the inlets 22 and 32 is separated therein. A stream of nitrogen is withdrawn from the top of the column 14 through the outlet 42. If desired, this stream of nitrogen 42 may be used to sub-cool the flows of liquid nitrogen and oxygen-enriched liquid air from the higher pressure rectification column 2 in one or more heat exchangers (not shown). If such sub-cooling is performed, it takes place upstream of the passage of the liquid streams through their respective Joule-Thomson valves. A main oxygen product containing 99.5% by volume of oxygen is withdrawn from the lower pressure rectification column 14 through the outlet 38. This main oxygen product contains less than 0.5% by volume of argon.

The section 40 in the lower pressure rectification column 14 is effective to strip argon and any other impurity more volatile than oxygen from the liquid descending the columns 14. The section 40 is typically designed to have 20 to 30 theoretical plates. Accordingly, the liquid issuing from the bottom of the section 40 contains less than 1 part by volume per million and typically less than 5 parts per thousand million by volume of argon impurity. Most of this liquid is reboiled in the reboiler-condenser 10 thereby providing the necessary cooling for the condensation of liquid nitrogen therein. A resulting oxygen vapour stream containing less than 1 part by volume and typically less than 10 parts per billion by volume of argon flows out of the lower pressure rectification column 14 through the outlet 44.

The size of the oxygen flow through the outlet 44 is typically relatively small compared with that through the outlet 38. However, if desired, as much as 40% of the total oxygen product withdrawn through the outlets 38 and 44 may flow through the outlet 44. In view of the withdrawal of oxygen through the outlet 38 in vapour state, relatively high reflux ratios may be maintained in the section 40 thereby facilitating the stripping of argon impurity from the liquid. If the main oxygen product were withdrawn from the lower pressure rectification column 14 in liquid state, there would be a need substantially to increase the number of theoretical stages in the section 40 or to reduce the proportion of oxygen product that flows through the outlet 44.

The flow of essentially argon-free oxygen through the outlet 44 passes into a side rectification column 48 through an inlet 50 at a bottom region of the column 48. The side rectification column 48 contains a single section 52 of packing or other liquid-vapour contact devices. The side column 48 is effective to absorb from the argon-free oxygen vapour those impurities that are less volatile than oxygen. The principal one of these impurities is typically methane. In addition, krypton and xenon will normally be present as less volatile impurities. The pressure at the top of the side rectification column 48 is typically in the range of 1 to 1.5 bar. Within this pressure range, the section 52 is normally designed to have from 10 to 20 theoretical stages. The vapour at the top of the column from which the less volatile impurities have been absorbed contains less than 1 volume per million and preferably significantly less than 10 parts per thousand million by volume of these less volatile impurities. Indeed, the total volume of impurities in the vapour at the top of the side column is preferably less than 10 parts per thousand million by volume. A stream of this vapour flows through the condenser-reboiler 30 and is thereby condensed. A part of the condensate is taken as ultra high purity liquid oxygen product through an outlet 54. The remainder is returned to the side column as reflux. Typically, the flow of argon-free gaseous oxygen into the inlet 50 to the side rectification column 48 is in the order of 1.5 times the flow of ultra high purity liquid oxygen product through the outlet 54. A flow of a liquid oxygen having an enhanced level of less volatile impurities including methane returns via a conduit 56 from the bottom of the side rectification column 48 to the sump of the lower pressure rectification column 14. The purge stream withdrawn from the lower pressure rectification column 14 through the outlet 46 is effective to purge less volatile impurities from the process. If desired, the purge stream may be mixed with the main oxygen product stream. It is also possible to take the purge stream from the liquid oxygen returning to the lower pressure rectification column 14 from the side rectification column 48.

Various modifications may be made to the method and apparatus described with reference to the accompanying drawing. If it be merely required that the oxygen product withdrawn through the outlet 44 from the lower pressure rectification column 14 be free of argon, the side rectification column 48 can be omitted. In this case, the entire oxygen-enriched liquid air flow from the bottom of the higher pressure rectification column 2 enters the lower pressure rectification column 14 in liquid state (unless an argon product is produced, in which case a part of this flow may be used to condense the argon product). It is also possible, though not preferred, to remove methane impurity from the argon-free oxygen flow not by using the rectification column 48 but by catalytic oxidation followed by adsorption of the resulting carbon dioxide. Another modification is to employ a throttling valve (not shown) in the conduit leading from the lower pressure rectification column 14 to the side rectification column 48. A further modification is to employ a liquid other than oxygen-enriched liquid air to cool the condenser-reboiler 30.

A yet further modification is to withdraw the essentially argon-free oxygen from the lower pressure rectification column 14 in liquid state. If this measure is adopted, the side rectification column 48 may operate at either the same, a higher or a lower pressure than the lower pressure rectification column 14. If a higher operating pressure is required, a pump or a liquid head may be used to transfer the liquid. If a lower operating pressure is required, the liquid may be throttled upstream of its entry into the side rectification column 48. If the side rectification column 48 does receive a liquid feed, it is provided with a reboiler (not shown) in a bottom region thereof so as to create the necessary vapour flow up the column. Further, if a liquid feed is employed to the side rectification column 48, it becomes convenient to take the purge stream directly from the bottom of the column 48 rather than from the sump of the lower pressure rectification column 14. The reboiler (not shown) at the bottom of the side rectification column may be heated by the same or a different fluid from that used to cool the condenser 30.

In addition to any of the above modifications, the lower pressure rectification column 14 may be used in a conventional manner to provide an argon-enriched feed to one or more rectification columns (not shown) which produce an argon product and/or to separate, in addition to the oxygen-enriched liquid air supplied from the higher pressure rectification column 2, either a stream of liquid air, typically taken from the same source as that which feeds the inlet 8 to the higher pressure rectification column 2, or a liquid stream comprising oxygen and nitrogen, the oxygen concentration being less than that of the oxygen-enriched liquid air, taken from an intermediate level of the higher pressure rectification column 2.

In addition to any of the above-described modifications, a further section of packing or other liquid-vapour contact devices can be interposed in the lower pressure rectification column 14 between the top of the condenser-reboiler 10 and the level at which the argon-free oxygen is taken from the column 14. Typically, such a further section is designed only to provide one or two theoretical plates, but nonetheless it has the effect of reducing the levels of methane and other less volatile ("heavy") impurities in the argon-free oxygen. Such a modification can have particularly utility if it is desired not to employ a side rectification column.

The packing employed in the columns may be any kind of packing which has (in comparison with sieve plates) a relatively low pressure drop per theoretical plate.

I claim:

1. An apparatus for separating from air a first oxygen product containing less than 3.5% by volume of argon impurity and a second relatively pure oxygen product containing less than 100 volumes per million of argon impurity comprising:

a higher pressure rectification column for fractionating an air stream so as to form a top vaporous nitrogen fraction and a bottom liquid fraction enriched in oxygen;

a lower pressure rectification column for separating a stream of the bottom fraction;

a condenser-reboiler for condensing a flow of the vaporous nitrogen fraction by indirect heat exchange with a liquid oxygen fraction separated in the lower pressure rectification column;

the condenser-reboiler being arranged so as to provide an upward flow of vapour through the lower pressure rectification column and to provide reflux for the higher pressure rectification column;

an inlet to the higher pressure rectification column for a stream of reflux;

said inlet communicating with the lower pressure rectification column;

a first outlet for the first oxygen product from an intermediate region of the lower pressure rectification column;

a packed section in the lower pressure rectification column arranged to receive liquid from the said intermediate region;

said packed section enabling said argon impurity to be stripped from the descending liquid;

a second outlet for the second oxygen product communicating with the bottom of the packed section;

the condenser-reboiler having condensing passages communicating with a single source of heating fluid; and the single source being a bottom region of the lower pressure rectification column.

2. The apparatus as claimed in claim 1, in which the second outlet communicates with a side rectification column for separating impurities less volatile than oxygen from the second oxygen product.

3. The apparatus as claimed in claim 2, in which the side rectification column has a condenser associated therewith.

4. The apparatus as claimed in claim 2, in which the side rectification column has a reboiler associated therewith.

5. The apparatus as claimed in claim 2, in which the side rectification column has an outlet for purging from the apparatus a liquid stream containing impurities less volatile than oxygen.

6. The apparatus as claimed in claim 2, in which the lower pressure rectification column has an outlet for purging from the apparatus a liquid stream containing impurities less volatile than oxygen.

* * * * *